US006769539B2

(12) United States Patent
Stern et al.

(10) Patent No.: US 6,769,539 B2
(45) Date of Patent: Aug. 3, 2004

(54) DEVICE FOR PROTECTING AND ADDING A COMPONENT TO A CONTAINER

(75) Inventors: Leif Stern, Lomma (SE); Elisabeth Sjoberg, Lund (SE); Bo Mollstam, Lerum (SE)

(73) Assignee: Biogaia AB, Gothenburg (SE)

( * ) Notice: Subject to any disclaimer, the term of this patent is extended or adjusted under 35 U.S.C. 154(b) by 23 days.

(21) Appl. No.: 09/992,825

(22) Filed: Nov. 14, 2001

(65) Prior Publication Data

US 2002/0066680 A1 Jun. 6, 2002

(51) Int. Cl.[7] ..... B65D 25/08
(52) U.S. Cl. ..... 206/222; 206/219
(58) Field of Search ..... 206/219, 222, 206/532; 222/80, 81; 426/77, 112, 115

(56) References Cited

U.S. PATENT DOCUMENTS

| | | | | |
|---|---|---|---|---|
| 2,631,521 | A | * | 3/1953 | Atkins, Jr. et al. |
| 3,326,363 | A | * | 6/1967 | Bennett et al. |
| 3,349,965 | A | * | 10/1967 | Krugger |
| 3,415,360 | A | * | 12/1968 | Baumann et al. |
| 3,779,372 | A | * | 12/1973 | deLloret |
| 3,968,820 | A | * | 7/1976 | Kolb |
| 4,074,827 | A | * | 2/1978 | Labe, III |
| 4,103,772 | A | | 8/1978 | Wiegner ..... 206/222 |
| 4,609,369 | A | * | 9/1986 | Ball |
| 4,785,931 | A | * | 11/1988 | Weir et al. |
| 4,874,618 | A | * | 10/1989 | Seaborne et al. |
| 5,035,320 | A | * | 7/1991 | Plone |
| 5,076,493 | A | | 12/1991 | Anderson ..... 229/125.15 |
| 5,115,913 | A | | 5/1992 | Anhauser et al. ..... 206/447 |
| 5,255,812 | A | * | 10/1993 | Hsu |
| 5,290,574 | A | * | 3/1994 | Jamieson et al. |
| 5,370,222 | A | * | 12/1994 | Steigerwald et al. |
| 5,419,429 | A | * | 5/1995 | Zimmerman et al. |
| 5,482,176 | A | | 1/1996 | Maietta et al. ..... 220/277 |
| 5,884,759 | A | * | 3/1999 | Gueret |
| 6,098,795 | A | * | 8/2000 | Mollstam et al. |
| 6,105,760 | A | * | 8/2000 | Mollstam et al. |
| 6,209,718 | B1 | * | 4/2001 | Mollstam et al. |

FOREIGN PATENT DOCUMENTS

| | | | |
|---|---|---|---|
| FR | 2 290 366 | * | 6/1976 |
| JP | 150620 | * | 6/1990 |
| WO | WO 01/05675 | * | 1/2001 |

* cited by examiner

*Primary Examiner*—David T. Fidei
(74) *Attorney, Agent, or Firm*—Lynn E. Barber

(57) ABSTRACT

A device comprising a compartment attached to a container that keeps a first component, which may be moisture sensitive, from a second component, preferably a liquid, until a selected time before use. The compartment has improved manufacturability and decreased leakage.

21 Claims, 8 Drawing Sheets

DEVICE FOR PROTECTING AND ADDING A COMPONENT TO A CONTAINER

BACKGROUND OF THE INVENTION

1. Field of the Invention

This invention relates to packages and containers, and in particular, pertains to drink or other containers having structures enabling addition of additives to the beverage or other component after sale of the containers and prior to consumption of the beverage or other component.

2. Description of the Related Art

Many different types of packages have been designed having two compartments to enable product components to be kept separate until use and, in some cases, to allow one component to remain sterile until use of the product. For example, see U.S. Ser. No. 09/775,486, filed Feb. 1, 2001, which is a divisional application of U.S. Ser. No. 09/598,792, filed Jun. 21, 2000, issued as U.S. Pat. No. 6.209,718 on Apr. 3, 2001, which is a divisional application of U.S. Ser. No. 08/949.465, filed Oct. 14, 1997, issued as U.S. Pat. No. 6,105,760 on Aug. 22, 2000; and U.S. Ser. No. 09/592,217, which is a divisional application of Ser. No. 09/265,453, filed Mar. 10, 1999, issued as U.S. Pat. No. 6,098,795 on Aug. 8, 2000, which is also a continuation-in-part application of U.S. Ser. No. 08/949,465, filed Oct. 14, 1997. Thus, U.S. Pat. Nos. 6,209,718; 6,105,760 and 6,098,795 disclose various delivery packages designed to contain an additive component. The delivery package is mounted in or on a main package and may be cut or punctured by a cutting means that is external to the delivery package when the user wishes to use the contents of the main package. These delivery packages may contain dried microbial cultures which are to be added to a food, liquid nutrition, medicine, or beverage product just before consumption, for the separate packaging of carbonation tablets from a liquid until just before consumption, and for separate packaging of vitamins or other unstable components before addition to a beverage, liquid nutrition, medicine or beverage before consumption. The main package may be a bag, such as an enteral bag or may hold a liquid beverage. The delivery package is preferably attached to the main package during the manufacturing process. The disclosure of all patents referred to herein is incorporated herein by reference.

In another type of two-compartment package, a stopper or other means is placed in the hole between the two compartments. For example, the two-compartment container of Halm (U.S. Pat. No. 5,417,321) comprises a one-piece container having two compartments assembled one upon another interlinked by a stoppered opening.

Other two-compartment packages utilize a perforating unit to allow the two previously separated components to mix. See, for example, the patents of Goncalves (U.S. Pat. No. 5,170,888 which has a glass defining a first compartment, which is provided with a neck upon which is mounted a bottle defining a second compartment, with a membrane between the two compartments that is perforated when a perforating unit is displaced relative to the glass, and U.S. Pat. No. 4,757,916 which has two units separated by a cover perforatable as a result of the manipulation of a mixing perforator). The two-part container of Wiegner (U.S. Pat. No. 4,103,772) has a frangible partition of coated aluminum foil dividing the compartments and a piercing member mounted on a resilient portion transversely directed toward the partition. In the patent of White (U.S. Pat. No. 4,637,934) rigid penetrating means are used to penetrate a compartment-closing diaphragm to allow nursing liquid to flow from the compartment to a communicating, attached nipple.

Two-compartment packages have also been previously developed which have an opening container attached to the top of the package and are provided with a screw cap and a cylinder jacket shaped supporting ring. The cylinder jacket shaped supporting ring is attached to the top of the package by means of a fixing flange externally surrounding the opening disc and is provided on its inner surface with a raised thread. The ring surrounds the external thread of the plastic screw cap. A cutter is integrally molded onto the free edge of the screw cap, and is provided with a front cutting edge, which passes at an angle through the free edge.

For such products as two-part epoxy glues, two compartments are also needed to keep the products from reacting, as in the patent of Wilkinson et al. (U.S. Pat. No. 4,786,279).

The dispenser of Renault (U.S. Pat. No. 5,564,600) has two compartments separated by a sealing member sealed against a seat, so that movement of one of the containers relative to the other causes the sealing member to move away from the seat and form an annular passage between the sealing member and the seat.

In some cases, such as with aseptically-filled bottles or cartons, there is a need to provide a means for adding a selected separate first component to a package after manufacture of the package and/or at a location on the package, which component may vary in concentration and/or composition, depending, for example, on the patient's history and diagnosis. Providing a means of attaching a first compartment to a package after both the first compartment and package have been manufactured allows a user to select both a particular first component to add to a package and the time and place of addition of the first component to the package. There is also need to have the capability to add beverage additives, particularly degradable or moisture-sensitive or oxygen-sensitive components (for example, vitamins) to liquid beverage bottles at or just before the time the beverage is consumed.

The types of structures used for many prior two-compartment containers are complicated and often subject to leakage. Thus, there remains a need to have two-compartment packages which keep a first component separate from a liquid component until use, so that the first component does not become wetted until just before use, that keep at least one of the components sterile until just before use, and in which the two components may be easily mixed just before use, and which has minimal or no leakage prior to mixing of the components and once the components have been mixed. For example, there is a need for such containers for the separate packaging of dried microbial cultures which are to be added to a food, liquid nutrition, medicine, or beverage product just before consumption, for the separate packaging of carbonation tablets from a liquid until just before consumption, and for separate packaging of vitamins or other unstable components before addition to a beverage, liquid nutrition, medicine or beverage before consumption.

It is therefore an object of the invention to provide a device comprising a compartment attached to a container that keeps a first component, which may be moisture sensitive, from a second component, preferably a liquid beverage, until a selected time before use.

It is a further object of the invention to provide a compartment that has improved manufacturability and decreased leakage.

Other objects and advantages will be more fully apparent from the following disclosure and appended claims.

SUMMARY OF THE INVENTION

The invention herein is a device comprising a compartment attached to a container. The separate first compartment keeps a first component, which may be moisture sensitive, separate from a second component, preferably a liquid, until a selected time before use. The compartment has improved manufacturability and decreased leakage.

Other objects and features of the inventions will be more fully apparent from the following disclosure and appended claims.

DETAILED DESCRIPTION OF THE INVENTION AND PREFERRED EMBODIMENTS THEREOF

The invention herein is a device that includes a compartment attached to a container. The first compartment keeps a first component, which may be moisture sensitive, separate from a second component, preferably a liquid, until a selected time before use.

Referring to the figures, the compartment 20 of the present invention, shown in FIGS. 3 and 5–8 enables addition of a granular or powdered component 18 to a container, such as a drink carton, prior to consumption of the contents of the container.

Figure 1:
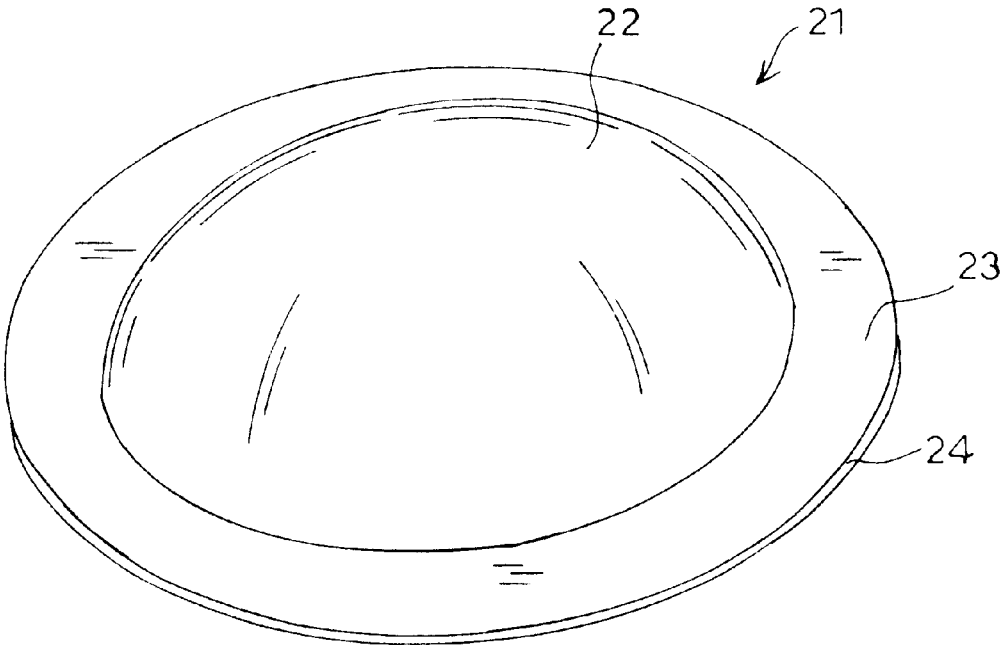
FIG. 1 is a top perspective view of the upper layer of the compartment of the invention.
Figure 2:
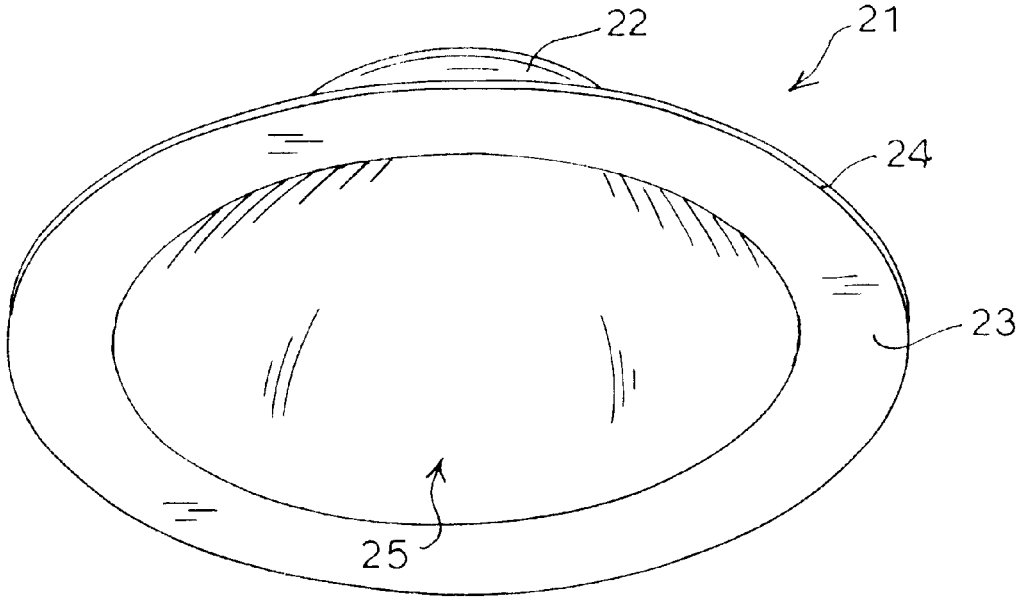
FIG. 2 is a bottom perspective view of the upper layer of the compartment of the invention.
Figure 3:
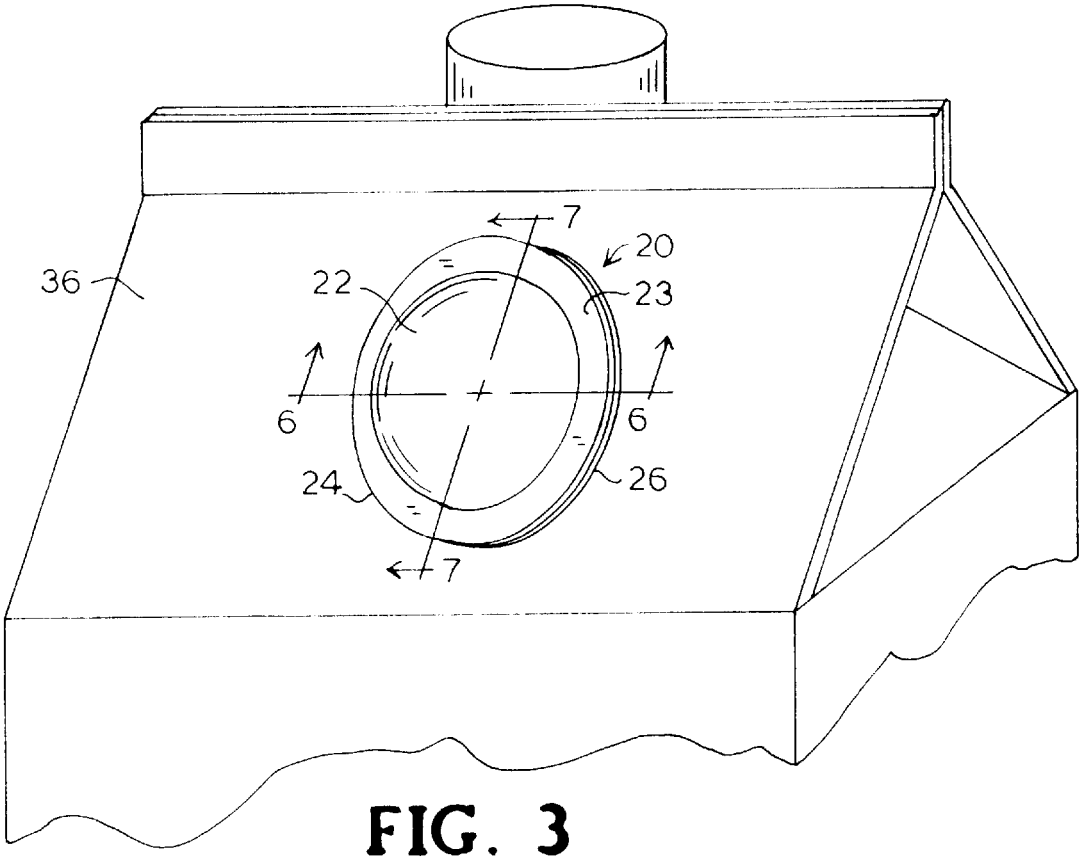
FIG. 3 is a perspective view of the top of a drink carton having a compartment of the invention mounted thereon.
Figure 5:
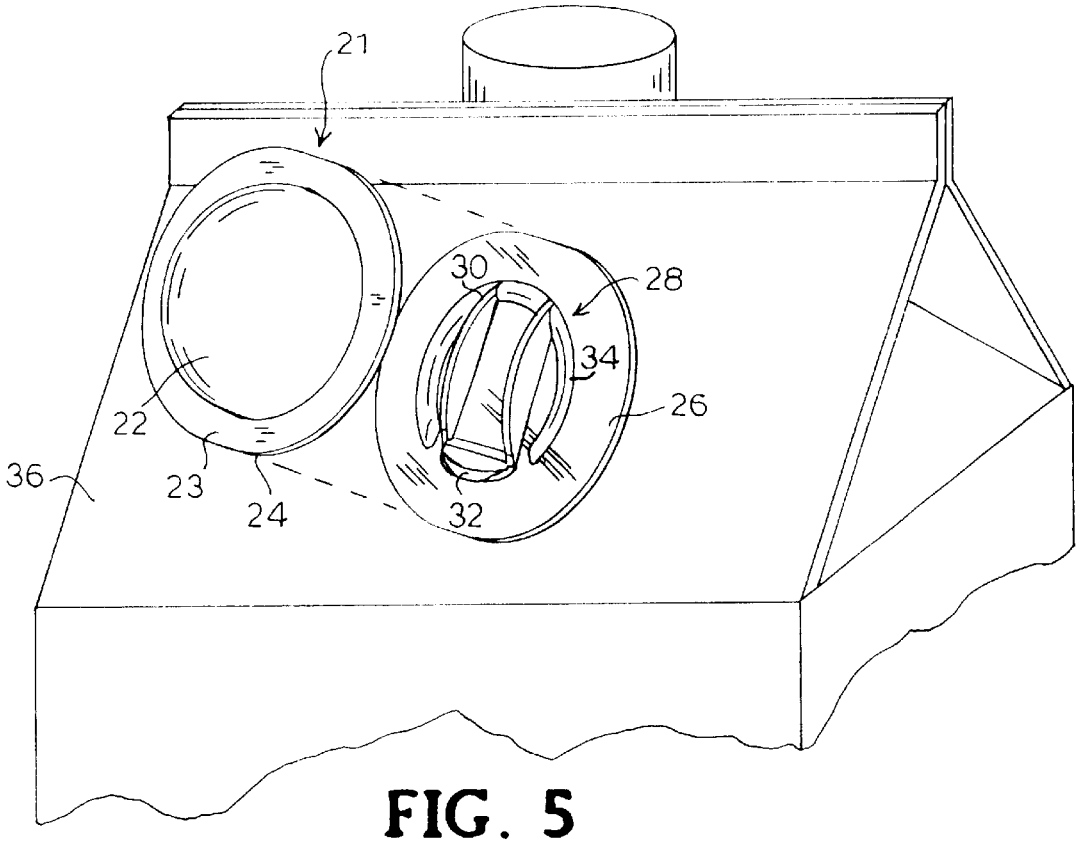
FIG. 5 shows the drink carton of FIG. 3 that has had the upper layer removed to show the mounted rim and cutter portion.
Figure 6:
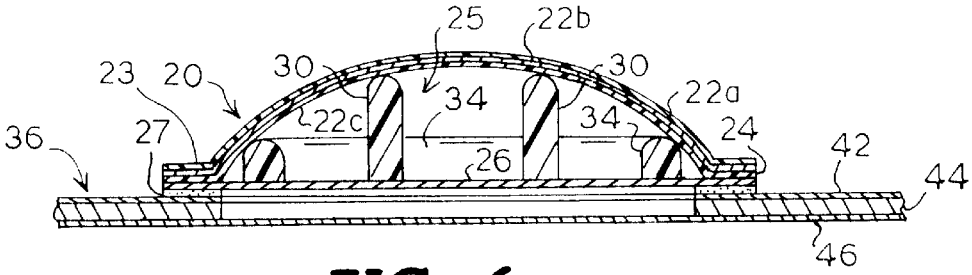
FIG. 6 is a cross-section along line 6—6 of FIG. 3.
Figure 7:
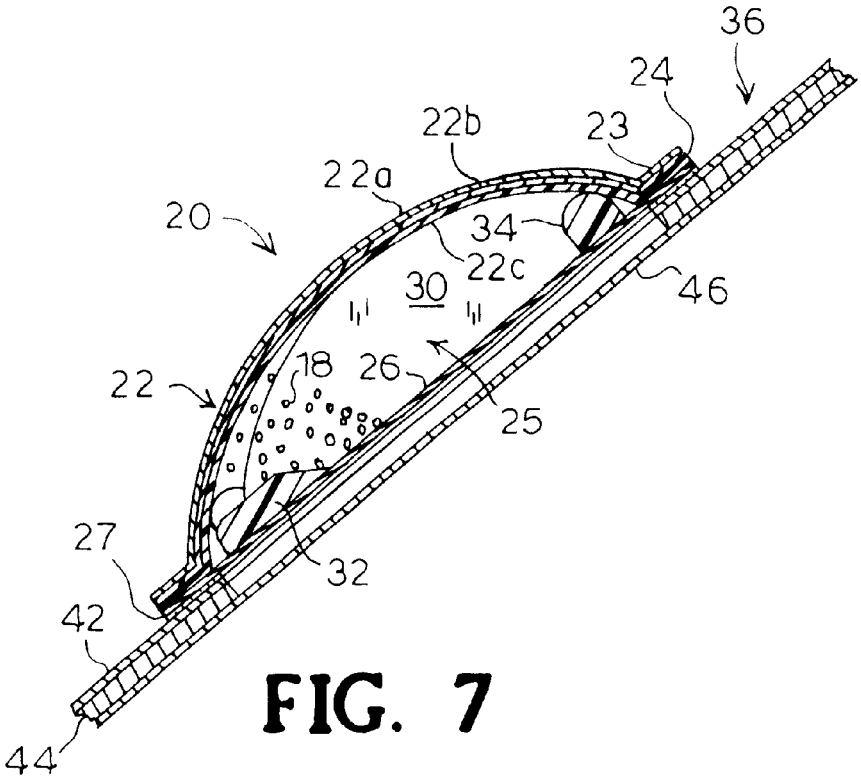
FIG. 7 is a cross-section along 7—7 of FIG. 3.
Figure 10A:
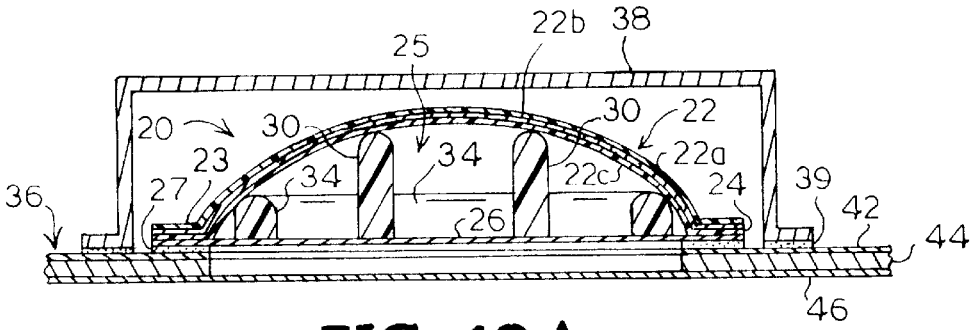
FIG. 10A is a cross-sectional view of the embodiment shown in FIG. 9.
Figure 10B:
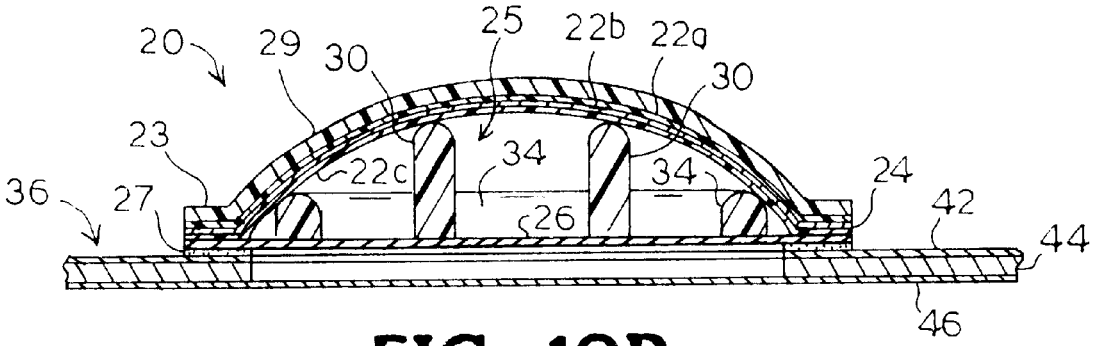
FIG. 10B is a cross-sectional view of a compartment in which the upper layer is made of a laminate of a foil laminate and a thick plastic layer

The compartment 20 comprises an upper layer 21 that is generally oval in shape in the preferred embodiment, as shown in FIGS. 1–2, although other shapes such as circular, diamond, and the like may be used as manufacturing considerations determine. Preferably, the smaller ends of the oval upper layer are aligned vertically on a drink carton as shown in FIG. 5 so that component 18 which falls by gravity to the lower end of compartment 20 is at one of the narrower ends as shown in FIG. 7. The upper layer 21 has an upwardly convex central portion 22 with a planar rim 23 extending around the central portion 22. The planar rim 23 is preferably of a constant width, with the outer edge 24 generally equidistant from the upper layer 21, as shown in the figures. Upper layer 21 is preferably made of a shape-retaining, but layer containing foil material, or a combination of foil and plastic as a laminate. Thus, a foil having a plastic layer on one or both surfaces, such as a polyethylene laminated aluminum foil, may be used (for example, with a foil layer 22*b* sandwiched between two thin plastic layers 22*a*,22*c*, as shown in FIGS. 6–8 and 10A–10B), or such a laminated aluminum foil, together with a thicker sturdy bendable plastic layer 29, as shown in FIG. 10B. When a thicker plastic layer 29 is part of the upper layer 21, a cap or other structure over the upper layer, as discussed in more detail below, need not be used to keep the upper layer 21 from accidentally being depressed before it is desired to add component 18 to the container. Use of plastic alone for the upper layer 21 is not desirable, since plastics tend not to be sufficiently impermeable to moisture, and it is important that moisture not be able to enter compartment 20 prior to opening of the compartment.

As shown in FIGS. 6–8, 10A and 10B, the compartment 20 also comprises a thin planar lower layer 26, preferably made of thin, easily puncturable foil. The lower layer 26 is parallel to the planar rim 23 and extends across and below the central portion 22 and the planar rim 23. In the process of manufacture of the compartments 20, component 18 is preferably added to the central portion 22 of multiple inverted upper layers 21 that have been formed on a single foil-containing sheet, prior to sealing another foil sheet, which then forms lower layer 26 of each compartment 20, to the planar rim 23 of each compartment. Such sealing is preferably by heat-sealing, to form multiple closed compartments 20, each of which has an inside area 25 for holding the component 18. Compartment 20 is sealed so that moisture and contaminants cannot enter the compartment and component 18 cannot exit the compartment until desired by the user of the container. The multiple compartments may then be separated from each other by cutting as is known in the art.

Lower layer 26 is attachable to the top area 36 of the main container by means know in the art, such as by an adhesive layer 27. It is important that this adhesive be a food-grade adhesive so that no problems arise if the beverage or additive component 18 come in contact with the adhesive after the compartment 20 is opened as discussed below. Acceptable adhesives are set forth the FDA portion of the Code of Federal Regulations (21 CFR 1 et seq.), and include E 115, made by Jackstadt GmbH, Wuppertal, Germany.

Figure 4:
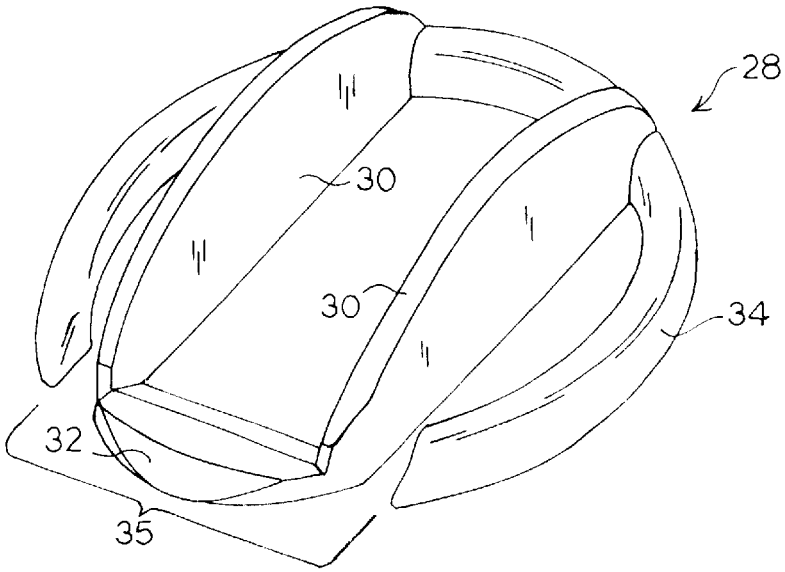
FIG. 4 is a top perspective view of the rim and cutter portion of the compartment.
Figure 8:
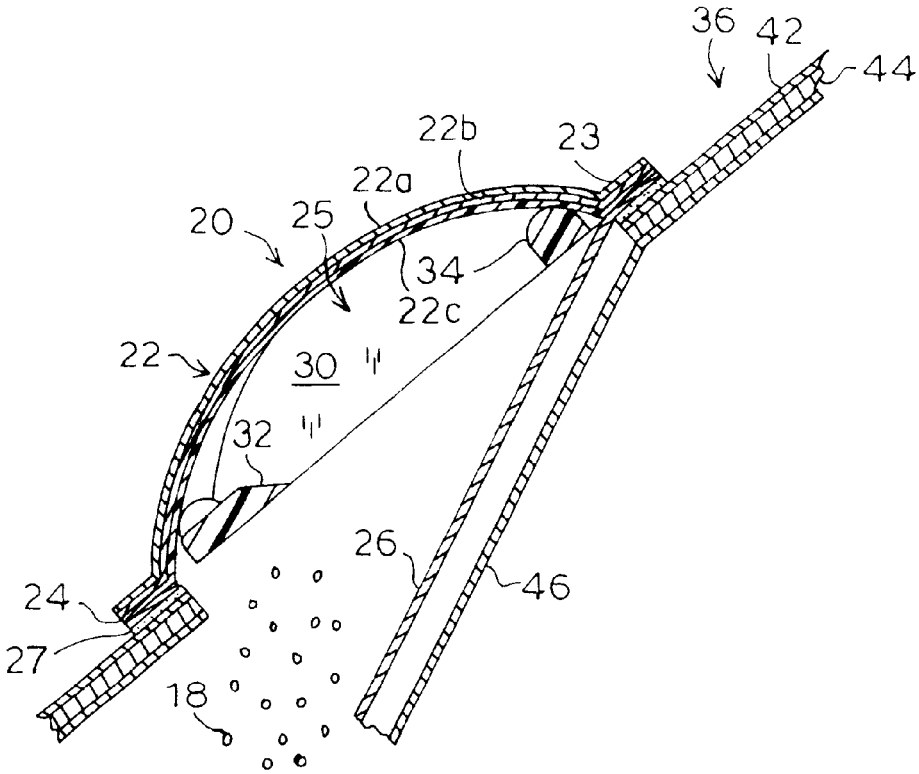
FIG. 8 is the view in FIG. 7, showing the invention after the lower layer of the compartment has been cut to allow the contents to enter the carton.

Contained within closed compartment 20 is cutter piece 28, which has an outer ring 34 having an opening 35 as shown in FIG. 4. The outer ring 34 is within and extends around the outside of the inside area 25. Cutter piece 28 also has least one linear ridged piece 30, each of which has a first end that is attached to and integral with the outer ring opposite the opening 35. Each linear ridged piece 30 extends across the outer ring 34, from the site of attachment of the first end toward the opening 35 as shown in FIG. 5. The second cutter end, containing cutter 32, is thus positioned within the opening 35. Preferably there are two linear ridged pieces 30 as shown in the figures, each of which is bowed upward in the same general arc shape made by the central portion 22 of upper layer 21, so that upper layer 21 rests on the linear ridged pieces 30 (FIGS. 6, 10A and 10B). Cutter piece 28 is positioned within compartment 20 so that the cutter 32 and the opening 35 are at the bottom of the compartment (the lowest point on the carton top 36) so that when the powdered or granulated component 18 falls by gravity within the compartment it is near the cutter 32 as shown in FIGS. 7–8.

As shown in FIGS. 12–16, the drink carton top 36 is preferably partially cut by a series of perforations 37 prior to mounting the compartment 20 on it. Typically, this kind of drink carton as known in the art is made of a three-layer material including an outer polymer film, a central cardboard layer, and an inner foil layer as shown in FIGS. 10A–10B. In the preferred embodiments of the invention, the polymer film layer 42 on top of the carton top 36 and the central cardboard layer 44 of a typical carton are perforated by means known in the art in an oval (or other appropriate shape) having the same shape and size as central portion 22, without perforation of the inner layer of which the carton is made, foil layer 46.

Figure 12:
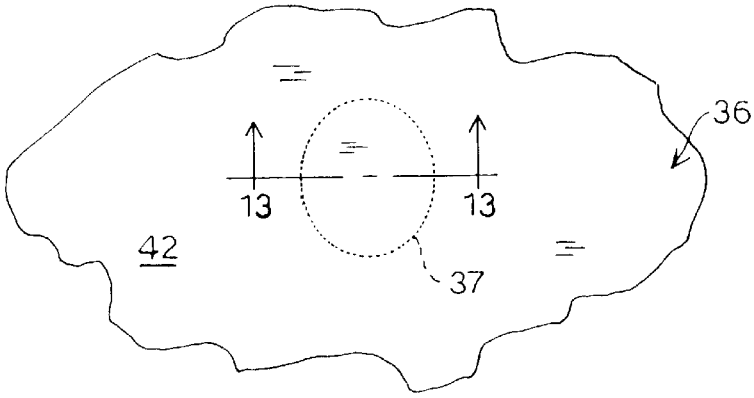
FIG. 12 is a plan view of a portion of the top of the carton that has been perforated prior to addition of a mounted compartment.
Figure 13:
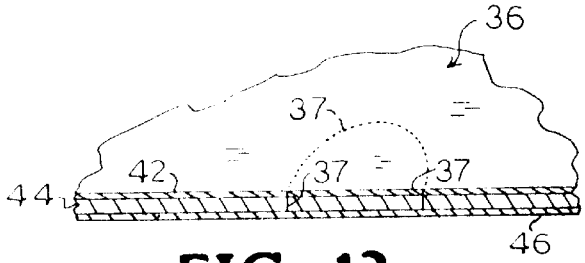
FIG. 13 is a cross-sectional view along 13—13 of FIG. 12.

In the first embodiment, shown in FIGS. 12–13, the portions of layers 42 and 44 within the perforations 37 are not removed prior to mounting the compartment 20 on the drink carton top 36. These perforated layers 42,44 plus the inner foil layer 46 remain on the carton beneath the compartment 20. In this case, when the central portion 22 of the compartment 20 is depressed by pushing downward on it, the linear ridge piece(s) 30 are depressed causing the cutter 32 at the second cutter end to puncture the lower layer 26, to push down layers 42 and 44, puncture foil layer 46, and release component 18 into the container. The cutter 32 need not have a sharp end, although it may have a sharp lower end. In either case, because of the thinness of the layers which must be punctured by the cutter when it is lowered, and because there are perforations around any thicker, non-foil layers, a consumer of the product in the container can easily cause the cutter 32 to force any intervening layers downward releasing the component 18 into the container.

Figure 14:
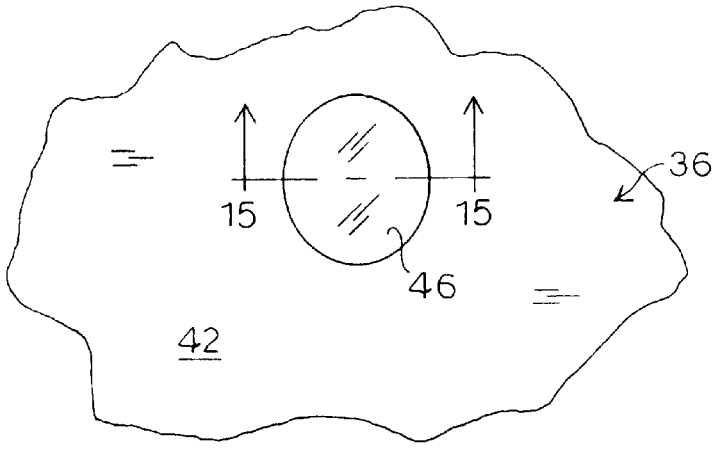
FIG. 14 is a plan view of a portion of the top of the carton shown in FIG. 12 in which the upper two layers within the perforations have been removed.
Figure 15:
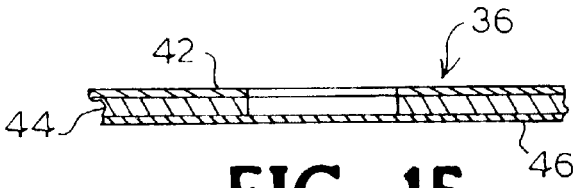
FIG. 15 is a cross-sectional view along 15—15 of FIG. 14.

In the second embodiment, shown in FIGS. 14–15, the area of layers 42 and 44 within the perforations 37 is removed prior to mounting the compartment 20 on the drink carton top 36. In this case, when the central portion 22 of the compartment 20 is depressed by pushing downward on it, the linear ridge pieces 30 are depressed, causing the cutter 32 at the second cutter end to puncture the lower layer 26 and foil layer 46, and release the component 18 into the container. Keeping foil layer 46 on the container before and during mounting of compartment 20 on the carton top 36, whether or not layers 42 and 44 are removed, reduces the possibility of contamination of the contents in the carton prior to consumption of the contents of the carton.

Figure 16:
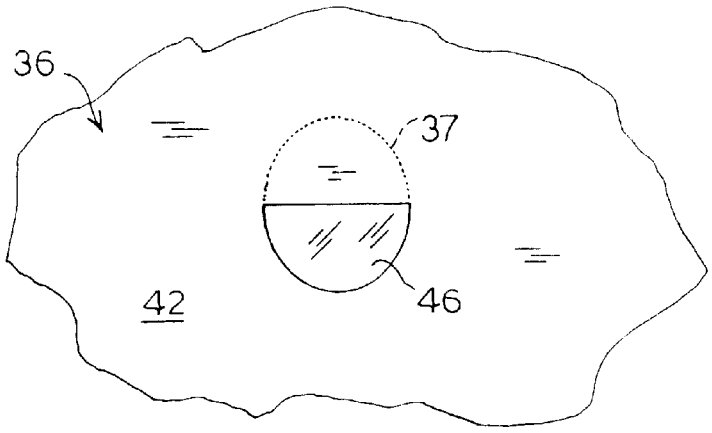
FIG. 16 is a plan view of the top of a portion of the carton shown in FIG. 12, in which half of the upper two layers have been removed inside the perforations.

Finally, in the third embodiment, shown in FIG. 16, some but not all of the layers 42 and 44 within the perforations 37 (preferably the portion of these layers that is lower on the top of the drink carton 36 when the compartment 20 is mounted on the carton, where both the cutter 32 and the component 18 are) is removed prior to mounting the compartment 20 on the drink carton top 36. In this case, when the central portion 22 of the compartment 20 is depressed by pushing downward on it, the linear ridge pieces 30 are depressed, causing the cutter 32 at the second cutter end to puncture the lower layer 26 and foil layer 45, and release the component 18 into the container. The advantage of the second and third embodiments over the first embodiment is that it is much easier to cut through the foil when there are not additional layers over the foil that need to be pushed down as well.

Figure 9:
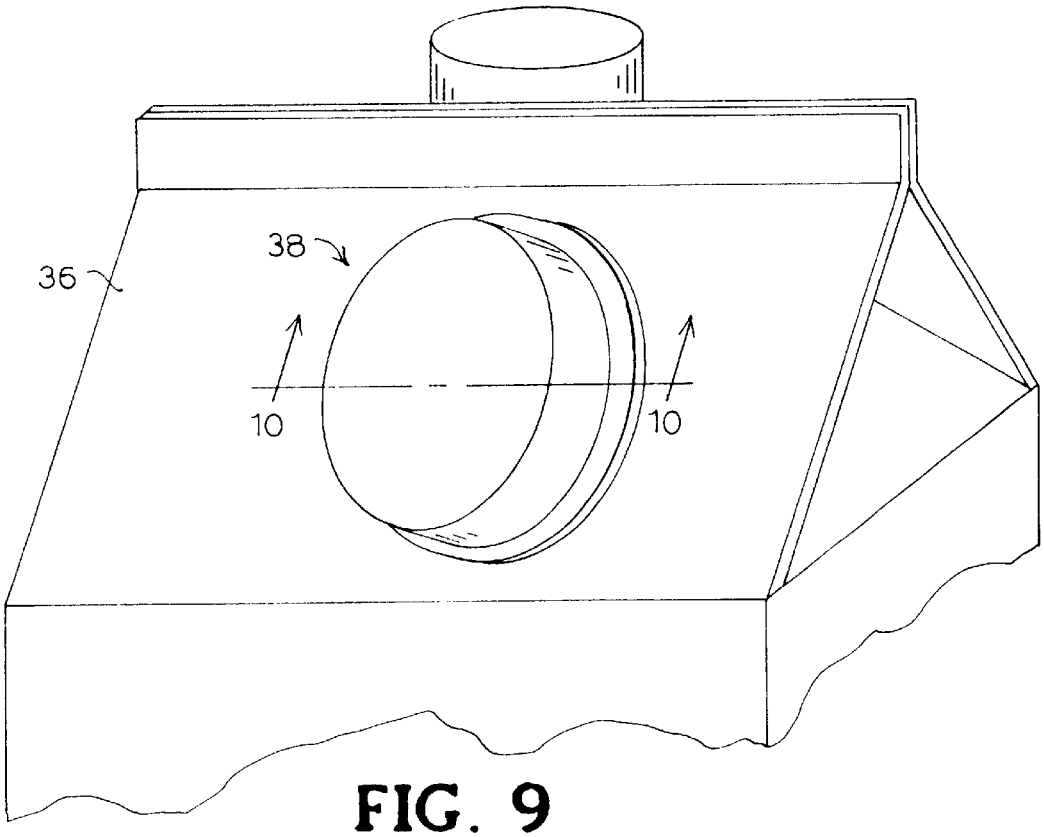
FIG. 9 is a perspective view showing the addition of a protective cap over the compartment of the invention.

In order to reduce the likelihood of accidental depression of the central portion 22, there preferably is a protective structure mounted over the central portion 22. As shown in FIGS. 9–10A, the protective structure may be in the form of a cap 38, such as a plastic cap as is known in the art, positioned over the container and attached to the compartment 20 and container, such as by means of an adhesive 39 or other means as is known in the art. Cap 38 may be removed from the carton by twisting.

Figure 11:
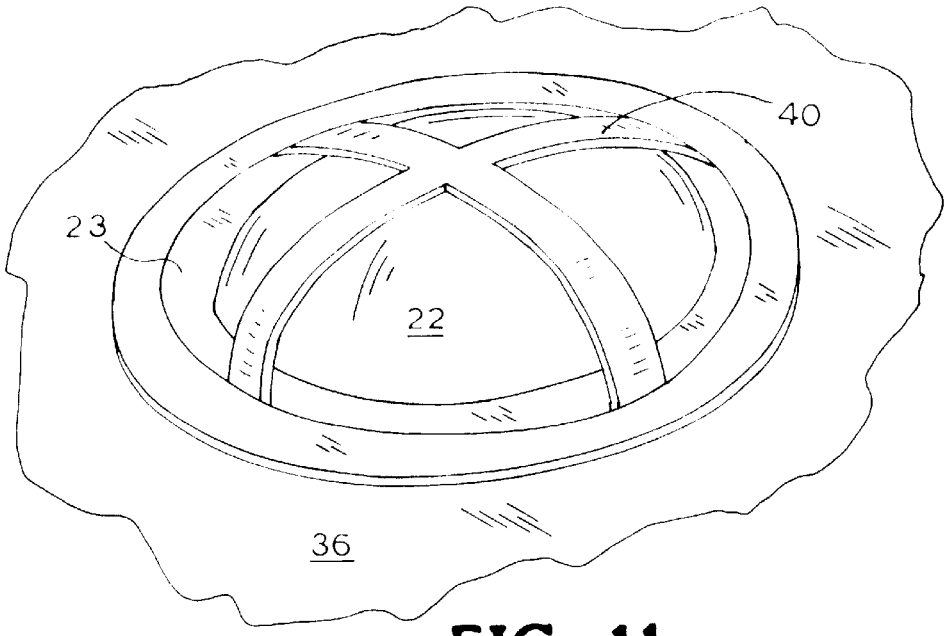
FIG. 11 is a perspective view of an alternative protective barred cap over the compartment of the invention.

Alternatively, as shown in FIG. 11, the protective structure may comprise breakable bars 40 mounted to a rim that is attached to the carton as known. The bars cross over the top of compartment 20. When sufficient force is placed on the bars, they break so that the upper layer 21 may be depressed and the cutter 32 cut through the layers beneath it and release the component 18 into the carton. This embodiment is preferably made of plastic, such as styrene or other hard, breakable plastic.

While the invention has been described with reference to specific embodiments, it will be appreciated that numerous variations, modifications, and embodiments are possible, and accordingly , all such variations, modifications, and embodiments are to be regarded as being within the spirit and scope of the invention.

What is claimed is:

1. A device for holding an additive component and for addition of the additive component to a container, comprising:

a) an upper layer having an upwardly convex central portion, and a planar rim extending around the central portion;

b) a thin, planar, puncturable lower layer parallel to the planar rim and extending across and below the central portion and the planar rim, and sealed to the planar rim to form a compartment having an inside area for holding the component, said lower layer attachable to a top area of the container; and c) a cutter piece within said compartment, comprising:

i) an outer ring having an opening, said outer ring within and extending around said inside area; and ii) at least one linear ridged piece, each linear ridged piece attached to the outer ring opposite the opening, each said linear ridged piece extending across the outer ring toward said opening, and comprising a cutter positioned within said opening;

wherein when lower layer is attached to the container and said central portion is depressed, the at least one linear ridge piece is depressed causing the cutter to puncture the lower layer and release the component into the container.

2. The device of claim 1, wherein the upper layer, the lower layer and the outer ring are oval shaped, with the at least one linear ridge piece extending across the length of the oval.

3. The device of claim 1, wherein there are two parallel linear ridged pieces.

4. The device of claim 1, further comprising an adhesive layer on the lower surface of the lower layer.

5. The device of claim 1, wherein the upper layer is made of a thin, flexible foil laminate.

6. The device of claim 5, wherein the upper layer further comprises a thicker plastic exterior layer laminated to the flexible foil laminate.

7. The device of claim 1, further comprising a cap over said central portion when the device is mounted on the container.

8. The device of claim 7, wherein the cap comprises crossed breakable bars.

9. A container having a device according to claim 1 mounted therein.

10. The container of claim 9, further comprising a cap over said convex central portion.

11. The container of claim 10, wherein the cap comprises breakable crossed bars over the convex central portion.

12. The container of claim 9, wherein there is a single foil layer of the container beneath the mounted device.

13. The container of claim 9, wherein when the top area of the container comprises an outer layer, a central cardboard layer and an inner layer, there are perforations through the outer layer and central cardboard layer beneath the compartment.

14. The container of claim 13, wherein a portion of the outer layer and of the central cardboard layer within the perforations is removed from the container before the compartment is attached to the container.

15. A method of making a container having a device mounted on the container for holding an additive component, comprising;

a) forming a device according to claim 1;

b) providing a container made of a material that has more than on layer, perforating at least one outer layer of the container around an area on the outer surface of the container where the device is to be mounted, and leaving the innermost layer of the container unperforated below said area; and c) mounting said device at said area on the container above the unperforated innermost layer at said area.

16. The method of claim 15, further comprising removing at least a portion of the at least one outer layer of the container within said area before mounting the device on the container.

17. The method of claim 16, wherein all of the at least one outer layer of the container within the area is removed before mounting the device on the container.

18. The method of claim 15, wherein the container is made of a material having three layers, and two layers are removed within said area before mounting the device on the container.

19. The method of claim 15, wherein the innermost layer is made of foil.

20. The method of claim 15, wherein the upper layer is made of a thin, flexible foil laminate.

21. The method of claim 20, wherein the upper layer further comprises a thicker plastic exterior layer laminated to the flexible foil laminate.

* * * * *